US012655990B2

(12) United States Patent
Lee et al.

(10) Patent No.: US 12,655,990 B2
(45) Date of Patent: Jun. 16, 2026

(54) COOKING EQUIPMENT

(71) Applicant: SAMSUNG ELECTRONICS CO., LTD., Suwon-si (KR)

(72) Inventors: Changhyun Lee, Suwon-si (KR); Yesil Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 415 days.

(21) Appl. No.: 18/386,010

(22) Filed: Nov. 1, 2023

(65) Prior Publication Data

US 2024/0060652 A1 Feb. 22, 2024

Related U.S. Application Data

(63) Continuation of application No. PCT/KR2022/006760, filed on May 11, 2022.

(30) Foreign Application Priority Data

Jun. 2, 2021 (KR) ..... 10-2021-0071258
Jul. 26, 2021 (KR) ..... 10-2021-0097942

(51) Int. Cl.
*F24C 15/08* (2006.01)
*F24C 15/00* (2006.01)
*F24C 15/20* (2006.01)

(52) U.S. Cl.
CPC ..... *F24C 15/08* (2013.01); *F24C 15/006* (2013.01); *F24C 15/20* (2013.01)

(58) Field of Classification Search
CPC ..... F24C 15/20; F24C 15/006; F24C 15/08; F24C 7/085; H05B 6/642; H05B 6/6435; H05B 6/6476
See application file for complete search history.

(56) References Cited

U.S. PATENT DOCUMENTS

2016/0334111 A1* 11/2016 Kim ..... F24C 7/086

FOREIGN PATENT DOCUMENTS

| | | |
|---|---|---|
| JP | 10-82557 | 3/1998 |
| JP | 2002-317943 | 10/2002 |
| JP | 2005-108897 | 4/2005 |
| JP | 2010-36732 | 2/2010 |
| JP | 2017-44366 | 3/2017 |
| KR | 20-1996-0002032 | 3/1996 |
| KR | 97-10474 | 3/1997 |

(Continued)

OTHER PUBLICATIONS

International Search Report, PCT/ISA/210, dated Aug. 19, 2023, in PCT Application No. PCT/KR2022/006760.

(Continued)

*Primary Examiner* — Alfred Basichas
(74) *Attorney, Agent, or Firm* — STAAS & HALSEY LLP

(57) ABSTRACT

A cooking equipment including a main body, and a controller mounted to the front of the main body. The controller includes a case, a bracket panel inside the case and accommodating a circuit board, and a guide panel detachably coupled, inside the case, to the bracket panel and the front surface of the main body. The guide panel includes a guide rib to guide a tool to enter the case to couple the guide panel to the bracket panel and the front surface of the main body or to detach the guide panel from the bracket panel and the front surface of the main body.

15 Claims, 20 Drawing Sheets

(56) References Cited

FOREIGN PATENT DOCUMENTS

| | | | |
|---|---|---|---|
| KR | 20-1998-0030341 | | 8/1998 |
| KR | 1998-029162 | | 8/1998 |
| KR | 2000-0009144 | | 5/2000 |
| KR | 20-0178145 | | 6/2000 |
| KR | 20-2000-0014795 | | 7/2000 |
| KR | 10-0395944 | | 8/2003 |
| KR | 20-0349868 | | 5/2004 |
| KR | 10-2006-0009598 | | 2/2006 |
| WO | WO2024106972 | * | 5/2024 |

OTHER PUBLICATIONS

Written Opinion, PCT/ISA/237, dated Aug. 19, 2023, in PCT Application No. PCT/KR2022/006760.
Office Action dated Jul. 22, 2025, in Korean Patent Application No. 10-2021-0097942.

* cited by examiner

COOKING EQUIPMENT

CROSS-REFERENCE TO RELATED APPLICATIONS

This is a continuation application of International Application PCT/KR2022/006760, filed May 11, 2022, which is incorporated herein by reference in its entirety, it being further noted that foreign priority benefit is based upon Korean Patent Application Nos. 10-2021-0071258, filed Jun. 2, 2021, and 10-2021-0097942, filed Jul. 26, 2021, the disclosures of which are incorporated by reference herein in their entireties.

TECHNICAL FIELD

The present disclosure relates to cooking equipment, and more specifically, to cooking equipment with an improved structure for preventing damage to a controller.

BACKGROUND ART

Cooking equipment is an appliance for heating and cooking an object to be cooked, such as food, and refers to a device capable of providing various functions related to cooking, such as heating, defrosting, drying, and sterilizing an object to be cooked. Examples of such cooking equipment include an oven such as a gas oven or an electric oven, a microwave heating device (hereinafter, referred to as a microwave), a gas range, an electric range, a microwave combined with hood (an Over The Range, OTR), a gas grill, an electric grill, and the like.

The OTR is a microwave with a hood function for ventilation in a kitchen, and may cook food more conveniently and efficiently while minimizing an installation space. The OTR may be located above cooking equipment such as a gas range or cooktop. That is, the OTR may be located above a cooking space.

Cooking equipment may include a controller for electronically controlling the cooking equipment. The controller may be assembled to a main body or disassembled from the main body for installation, repairs and maintenance of the cooking equipment. For cooking equipment positioned above a cooking space like the OTR, an operator may require to assemble or disassemble the controller without being able to see the controller. In this instance, the operator may press the controller with a tool, which may damage an appearance of the controller.

DISCLOSURE

Technical Problem

The disclosure is directed to providing cooking equipment with an improved structure capable of preventing damage to a controller upon assembly or disassembly of the controller.

The disclosure is directed to providing cooking equipment capable of guiding a tool upon assembly or disassembly of a controller.

Technical Solution

According to an embodiment of the disclosure, a cooking equipment may include a main body; and a controller mounted on a front of the main body, wherein the controller may include a case, a bracket panel inside the case and accommodating a circuit board, and a guide panel detachably coupled to the bracket panel and a front surface of the main body inside the case, wherein the guide panel may include a guide rib configured to guide a tool to enter the case to couple the guide panel to the bracket panel and the front surface of the main body or to detach the guide panel from the bracket panel and the front surface of the main body.

According to an embodiment of the disclosure, the guide rib may have a shape inclined downward toward a rear of the cooking equipment.

According to an embodiment of the disclosure, the guide rib may be configured to support an outer circumferential surface of the tool.

According to an embodiment of the disclosure, the case may include an opening on an upper surface of the case, and the guide panel may be configured so that, when the tool enters the case, the tool may enter the guide panel through the opening of the case, and may be in first contact with the guide rib and not the case.

According to an embodiment of the disclosure, the main body may include a first hole on the front surface, the bracket panel may include a second hole corresponding to the first hole, the guide panel may include a third hole corresponding to the second hole, and the first hole, the second hole, and the third hole may be configured to be screwed together.

According to an embodiment of the disclosure, an uppermost end of the guide rib may be located above a center of the third hole of the guide panel.

According to an embodiment of the disclosure, the guide panel may further include a body seated on an upper surface of the guide panel, and the guide rib may extend upward from the body.

According to an embodiment of the disclosure, the controller may further include an intake grille configured to cover an upper portion of the case and including a cooling air inlet communicating with an outside of the cooking equipment, and the guide panel may be between a lower side of the intake grille and an upper side of the bracket panel.

According to an embodiment of the disclosure, the main body may include a cooking chamber and an electronic equipment chamber partitioned from the cooking chamber, and a rear of the controller may be adjacent to the electronic equipment chamber.

According to an embodiment of the disclosure, the cooling air inlet may be a first cooling air inlet, the main body may further include a second cooling air inlet on the front surface of the main body and configured to communicate with the first cooling air inlet, to allow air introduced through the first cooling air inlet of the intake grille to be introduced to the electronic equipment chamber.

According to an embodiment of the disclosure, the intake grille may be configured to cover the guide panel and the second cooling air inlet of the main body.

According to an embodiment of the disclosure, the guide rib may include a first rib, and a second rib behind the first rib and having a height lower than the first rib.

According to an embodiment of the disclosure, the guide panel may be configured to couple the case and the bracket panel.

According to an embodiment of the disclosure, the bracket panel may include a first hole, the guide panel may include a second hole corresponding to the first hole, the case may include a third hole corresponding to the second hole, and the first hole, the second hole, and the third hole may be configured to be screwed together.

According to an embodiment of the disclosure, the body of the guide panel may be spaced apart from a rear surface of the case and have a shape inclined downward toward a front of the cooking equipment, to guide moisture introduced into the controller between the guide panel and the case.

According to an embodiment of the disclosure, a cooking equipment may include a main body including a cooking chamber and an electronic equipment chamber partitioned from the cooking chamber and in which an electronic component is disposed, a door configured to open and close the cooking chamber of the main body, and a controller detachably mounted to a front of the electronic equipment chamber of the main body, wherein the controller may include a circuit board configured to be electrically connected to the electronic component, a bracket panel configured to form an accommodation space for accommodating the circuit board, and a guide panel configured to detachably couple the bracket panel to the main body, wherein the guide panel may include a guide rib configured to guide a movement of a tool entering the guide panel to couple the bracket panel to the main body or decouple the bracket panel from the main body.

According to an embodiment of the disclosure, the controller may further include a case configured to accommodate the circuit board, the bracket panel and the guide panel and form an exterior of the controller, and a cover panel configured to cover an upper portion of the case.

According to an embodiment of the disclosure, the cover panel may include a cooling air inlet configured to communicate with an outside, and to which air for cooling the electronic component is introduced.

According to an embodiment of the disclosure, the controller may be disposed between the door and the main body, and when the cooking chamber is closed by the door, a front of the controller may be covered by the door.

According to an embodiment of the disclosure, the guide rib may be configured to support an outer circumferential surface of the tool and have a shape inclined downward toward a rear.

Advantageous Effects

According to an embodiment of the disclosure, cooking equipment may have an improved structure capable of preventing damage to a controller upon assembly or disassembly of the controller.

According to an embodiment of the disclosure, cooking equipment may guide an entry of a tool.

MODES OF THE INVENTION

Figure 1:
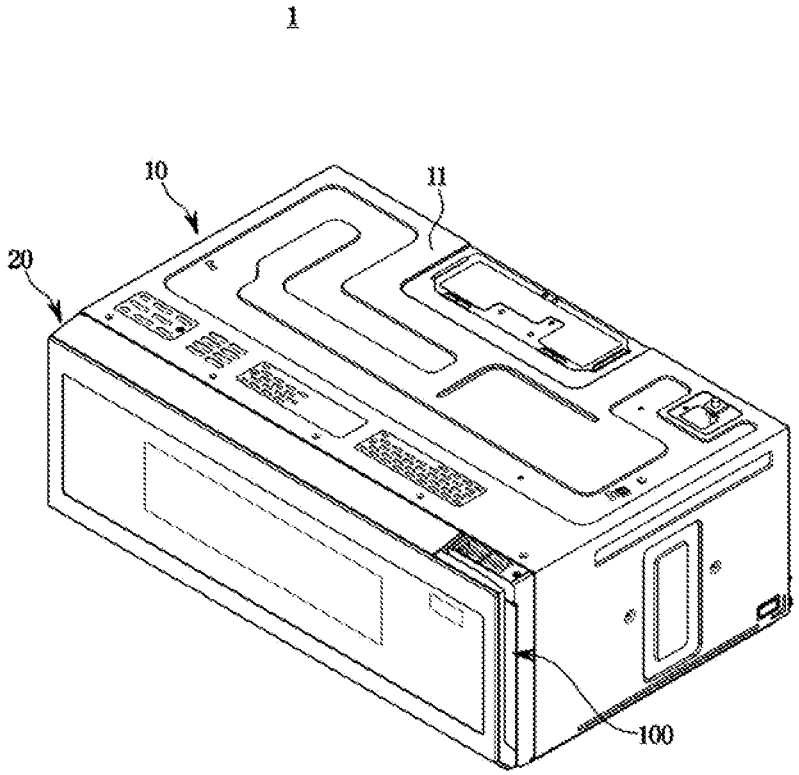
FIG. 1 is a perspective view of cooking equipment according to an embodiment of the disclosure.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numbers or signs shown in the drawings of the disclosure indicate elements or components performing substantially the same function.

Also, the terms used herein are used to describe the embodiments and are not intended to limit and/or restrict the disclosure. The singular forms "a," "an," and "the" are intended to include the plural forms unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc. may be used herein to describe various elements, the elements are not limited by these terms. These terms are used only to distinguish one element from another. For example, without departing from the scope of the disclosure, a first element may be referred to as a second element, and a second element may be referred to as a first element. The term "and/or" includes a plurality of combinations of relevant elements or any one of a plurality of relevant elements.

Hereinafter, embodiments of the disclosure are described in detail with reference to accompanying drawings.

Figure 2:
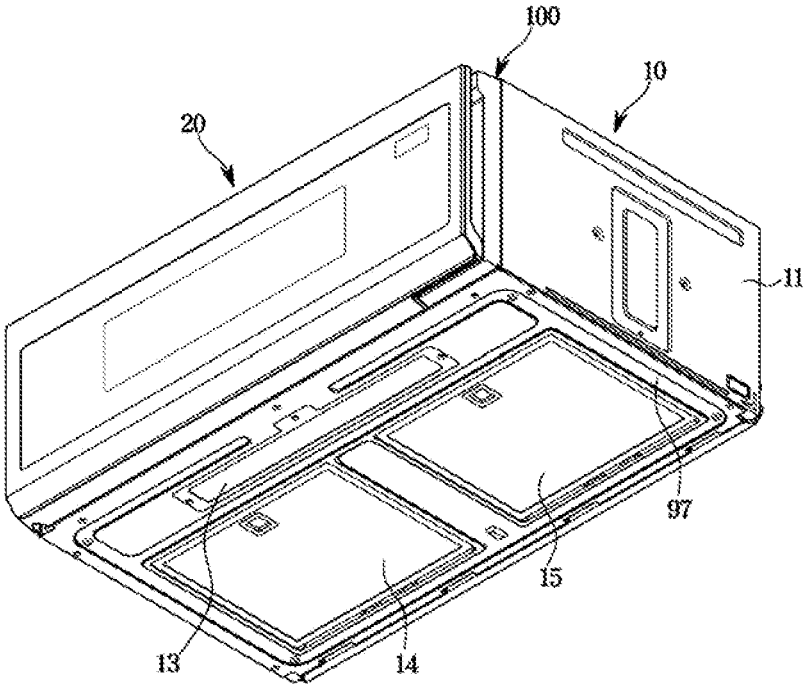
FIG. 2 is a bottom perspective view of the cooking equipment according to an embodiment of the disclosure.
Figure 3:
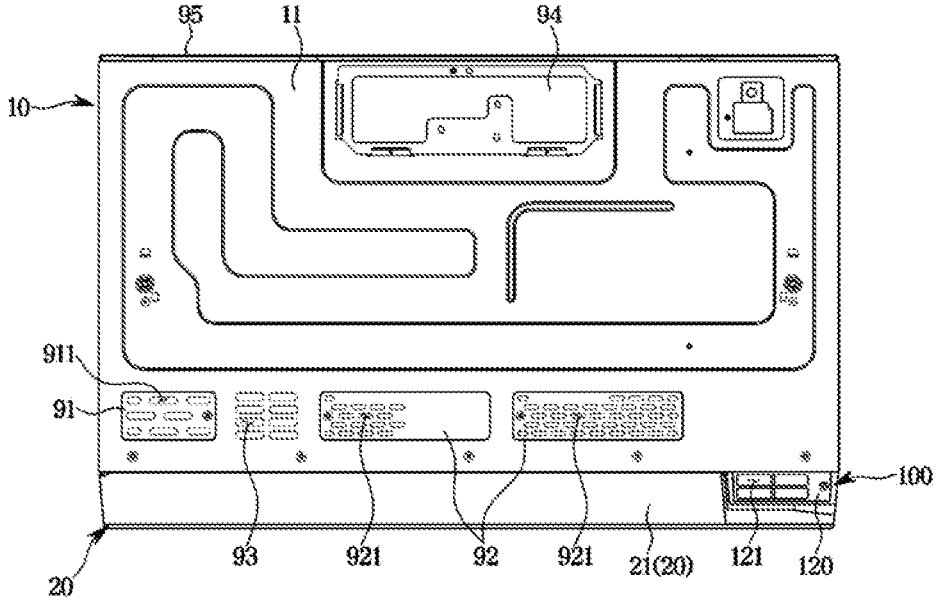
FIG. 3 is a top view of the cooking equipment according to an embodiment of the disclosure.
Figure 4:
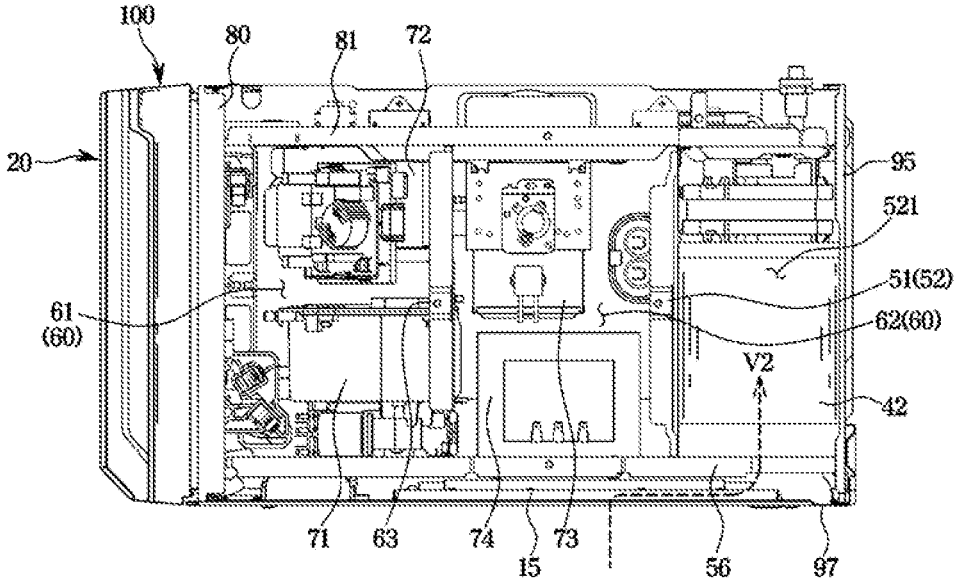
FIG. 4 is a side view illustrating one side of the cooking equipment according to an embodiment of the disclosure in which an outer housing is removed.
Figure 5:
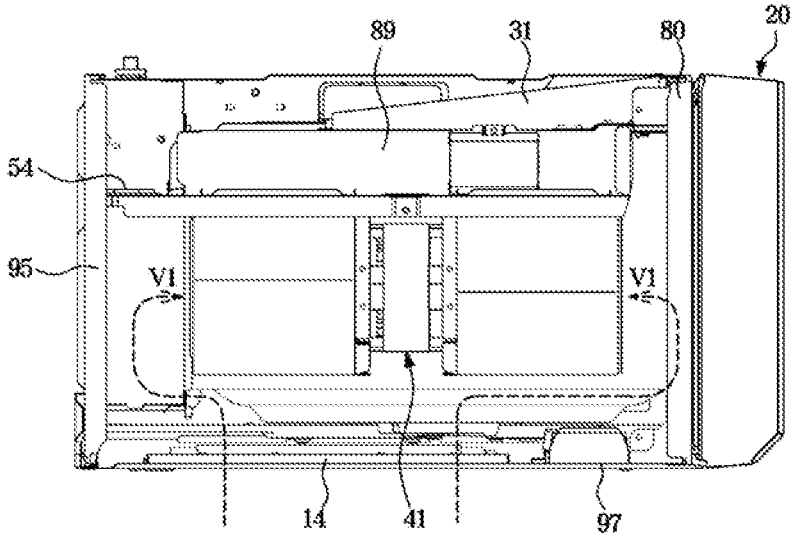
FIG. 5 is a side view illustrating the other side of the cooking equipment according to an embodiment of the disclosure in which the outer housing is removed.

FIG. 1 is a perspective view of a cooking equipment according to an embodiment of the disclosure. FIG. 2 is a bottom perspective view of the cooking equipment according to an embodiment of the disclosure. FIG. 3 is a top view of the cooking equipment according to an embodiment of the disclosure. FIG. 4 is a side view illustrating one side of the cooking equipment according to an embodiment of the disclosure in which an outer housing is removed. FIG. 5 is a side view illustrating the other side of the cooking equipment according to an embodiment of the disclosure in which the outer housing is removed.

The cooking equipment 1 according to an embodiment of the disclosure may be provided as an over-the-range (OTR). Hereinafter, the cooking equipment 1 is referred to as the cooking equipment 1.

Referring to FIG. 1 to FIG. 3, the cooking equipment 1 may include a main body 10 and a door 20 coupled to a front side of the main body 10. The cooking equipment 1 may include a controller 100 detachably mounted to the front side of the main body 10.

The main body 10 may include an outer housing 11 and an inner housing 12 provided inside the outer housing 11. A cooking chamber 30 and an electronic equipment chamber 60 may be provided inside the inner housing 12. The cooking chamber 30 and the electronic equipment chamber 60 may be provided to be partitioned from each other.

The door 20 may be configured to open and close the cooking chamber 30. Specifically, the door 20 may be rotatably coupled to the main body 10. A user may open and close the door 20 using a handle formed between the controller 100 and the door 300.

A portion of a rear portion of the door 20 may be recessed to cover a front side of the controller 100. One side of the door 20 may be recessed inward from the rear side to accommodate the controller 100.

The cooking equipment 1 may include the controller 100 detachably mounted to the front side of the main body 10. The front of the controller 100 may be covered by the door 20. More specifically, the controller 100 may be coupled to the main body 10 so as to be disposed between the door 20 and the main body 10.

Referring to FIG. 2, a first circulation air intake 14 and a second circulation air intake 15 may be formed on a lower surface of the main body 10. More specifically, the first circulation air intake 14 and the second circulation air intake 15 may be formed on a bottom plate 97 of the main body 10.

Polluted air generated at a lower side of the cooking equipment 1 may be drawn into the cooking equipment 1 through the first circulation air intake 14 and the second circulation air intake 15. In this instance, the polluted air may include oil vapor, exhaust gas, smoke, foreign substances, and food odors generated in the cooking space. The first circulation air intake 14 may include a first circulation air inlet (not shown). The second circulation air intake 15 may include a second circulation air inlet (not shown).

The polluted air drawn into the inside of the cooking equipment 1 may be filtered by a filter (not shown) inside the cooking equipment 1 and discharged to the outside of the cooking equipment 1. The filter may be arranged to correspond to the first circulation air intake 14 and the second circulation air intake 15. Details of circulation flow paths V1 and V2 will be described later.

The main body 10 may include a lighting unit 13. The lighting unit 13 may be disposed in front of the first circulation air intake 14 and the second circulation air intake 15. The lighting unit 13 may be provided to irradiate light to the lower side of the cooking equipment 1 in a state where a cooktop is installed under the cooking equipment 1.

Referring to FIG. 3, a service panel 91 and a discharge panel 92 may be disposed on an upper surface of the main body 10. Specifically, the service panel 91 may be detachably mounted on the upper surface of the outer housing 11. The discharge panel 92 may be detachably mounted on the upper surface of the outer housing 11.

In addition, a ventilation duct panel 94 may be disposed on the upper surface of the main body 10. The ventilation duct panel 94 may be detachably mounted to the outer housing 11.

Although it is illustrated that two discharge panels 92 are formed according to an embodiment of the disclosure, the number of discharge panels 92 is not limited thereto.

The service panel 91 may include a first circulation air outlet 911. Each of the discharge panels 92 may include a second circulation air outlet 921.

The polluted air introduced into the main body 10 through the first circulation air intake 14 and the second circulation air intake 15 formed on the lower surface of the main body 10 may be filtered, and then discharged to the outside of the cooking equipment 1 through the first circulation air outlet 911 and the second circulation air outlet 921.

In the above description of the cooking equipment 1 according to an embodiment of the disclosure, it has been described that the first circulation air outlet 911 and the second circulation air outlet 921 are formed in the service panel 91 and the discharge panel 92, and the filtered air is discharged into the interior through the upper surface of the cooking equipment 1.

However, the disclosure is not limited thereto, and in a state where a separate communication duct (not shown) connected to the outside is provided in a space where the cooking equipment 1 is mounted, the service panel 91 may not include the first circulation air outlet 911, and the discharge panel 92 may also not include the second circulation air outlet 921.

Alternatively, a circulation air outlet (not shown) provided to communicate with the communication duct may be formed in the ventilation duct panel 94. In this case, the oil vapor introduced into the first circulation air intake 14 and the second circulation air intake 15 may be filtered and moved to the communication duct through the ventilation duct panel 94 of a rear upper surface of the cooking equipment 1, thereby being discharged to the outside.

In other words, the circulation air outlet may be formed in the ventilation duct panel 94, while the first circulation air outlet 911 is not formed in the service panel 91 and the second circulation air outlet 921 is not formed in the discharge panel 92. Accordingly, all the filtered oil vapor may be discharged to the outside without being discharged to the inside.

Accordingly, the indoor air may be maintained much cleaner, and because a temperature of cooling air introduced through a cooling flow path C, which will be described later, is lower, the cooling efficiency of the cooking equipment 1 may be increased.

Furthermore, because the service panel 91, the discharge panel 92 and the ventilation duct panel 94 are detachably installed in the outer housing 11, the service panel 91, the discharge panel 92 and the ventilation duct panel 94 may be mounted on the outer housing 11 as required.

Specifically, when it is required to discharge the filtered air to the inside because the separate communication duct (not shown) is not provided, the service panel 91 and the discharge panel 92 including the circulation air outlet may be mounted on the outer housing 11, and the ventilation duct panel 94 without the circulation air outlet may be mounted on the outer housing 11.

Conversely, when it is not required to discharge the filtered air to the inside because the separate communication duct (not shown) is provided, the service panel 91 and the discharge panel 92 without the circulation air outlet, respectively, may be mounted on the outer housing 11, and the ventilation duct panel 94 including the circulation air outlet may be mounted on the outer housing 11.

The controller 100 may include an intake grille 120 provided to cover an upper portion of the controller 100.

The intake grille 120 may be disposed on the front side of the discharge panel 92. More specifically, the intake grille 120 may be accommodated in a recessed portion of the door 20, and the intake grille 120 may be arranged on one side of the door 20 to be parallel to the door 20. In this case, the intake grille 120 may be disposed behind a portion of the door 20.

Air outside the cooking equipment 1 may be introduced into the main body 10 through the intake grille 120. The intake grille 120 may include a first cooling air inlet 121. Accordingly, the first cooling air inlet 121 may be formed in the intake grille 120 to allow air to be introduced therethrough so as to cool the electronic equipment chamber 60.

The air introduced through the intake grille 120 may cool the electronic equipment chamber 60 and then flow back into the cooking chamber 30 to cool a rear surface of the door 20, and then be discharged to a cooling air outlet 93 formed on the upper surface of the main body 10. More specifically, the cooling air outlet 93 may be formed by cutting a portion of the upper surface of the outer housing 11.

Referring to FIG. 4, the inner housing 12 of the main body 10 may include an upper plate 81 and a front plate 80. The upper plate 81 may form an upper surface of the inner housing 12. The front plate 80 may form a front surface of the main body 10. The front plate 80 may form a front surface of the inner housing 12.

The controller 100 may be mounted to the front of the front plate 80. The electronic equipment chamber 60 may be provided at the rear of the front plate 80.

The electronic equipment chamber 60 may include a first electronic equipment chamber 61 and a second electronic equipment chamber 62. Various electronic components may be disposed in the electronic equipment chamber 60.

In the main body 10, the electronic equipment chamber 60 may be provided to be partitioned by the front plate 80, the upper plate 81, a cooling divider 51, and a circulation plate 56. Further, the electronic equipment chamber 60 may be divided into two spaces by a partition plate 63 defining the first electronic equipment chamber 61 and the second electronic equipment chamber 62.

The circulation plate 56 may form a bottom surface of the electronic equipment chamber 60. The circulation plate 56 may be provided to be spaced apart from the bottom plate 97 of the outer housing 11.

The cooling divider 51 may be disposed above the circulation plate 56 and include a vertically extending shape. The cooling divider 51 may be provided as one surface of a rear bracket 52 to be described later. For example, the cooling divider 51 may correspond to one surface facing the partition plate 63 of the rear bracket 52.

Because the electronic equipment chamber 60 is partitioned by the circulation plate 56 and the cooling divider 51, the oil vapor introduced through the second circulation air intake 15 formed on the lower surface of the main body 10 may not be introduced into the electronic equipment chamber 60. Accordingly, components in the electronic equipment chamber 60 may be protected from oil vapor or other foreign substances.

A cooling fan 71 may be accommodated in the first electronic equipment chamber 61. The cooling fan 71 may form air flow to allow external air to be introduced into the intake grille 120.

In addition, because the controller 100 is mounted on the front panel 80 to communicate with the first electronic equipment chamber 61, the air introduced into the intake grille 120 may cool the controller 100, which will be described later.

A magnetron 73 and a transformer 74 may be accommodated in the second electronic equipment chamber 62. The magnetron 73 and the transformer 74 may be configured to generate a high frequency. The generated high frequency may be supplied to the inside of the cooking chamber 30 to heat an object to be cooked.

The partition plate 63 provided to define the first electronic equipment chamber 61 and the second electronic equipment chamber 62 may be partially opened. The partition plate 63 may include a lower opening (not shown) communicating with the cooling fan 71 to allow air, drawn into the intake grille 120 by the cooling fan 71, to be introduced into the second electronic equipment chamber 62 through the first electronic equipment chamber 61. The partition plate 63 may also include an upper opening (not shown) with which the second electronic equipment chamber 62 and a guide duct 72 communicate.

The air introduced into the second electronic equipment chamber 62 may cool the transformer 74 and the magnetron 73, and then flow into the guide duct 72 mounted on the partition plate 63. The guide duct 72 may be disposed in the first electronic equipment chamber 61 to form a space with which the second electronic equipment chamber 62 and the inside of the cooking chamber 30 communicate.

Accordingly, the air flowing to the guide duct 72 may flow into the cooking chamber 30 to cool the rear surface of the door 20. Thereafter, the air may flow into an exhaust duct 31 communicating with the upper surface of the cooking chamber 30, and be discharged to the outside of the cooking equipment 1 through the cooling air outlet 93 communicating with the exhaust duct 31.

In addition to the cooling flow path C provided to cool the electronic equipment chamber 60 and the door 20, the cooking equipment 1 may include circulation flow paths V1 and V2 provided to draw in and filter polluted air including oil vapor and to discharge the filtered air.

Referring to FIG. 4 and FIG. 5, the cooking equipment 1 may include circulation fans 41 and 42 configured to generate an intake force to draw in polluted air. For example, the circulation fans 41 and 42 may include the first circulation fan 41 and the second circulation fan 42 provided on both sides with the cooking chamber 30 interposed therebetween. Because the first circulation fan 41 and the second circulation fan 42 are disposed on opposite sides inside the main body 10, an overall height of the main body 10 may be reduced and a larger kitchen space may be secured.

Further, in the cooking equipment 1, the plurality of circulation flow paths V1 and V2 including the first circulation flow path V1 flowing by the first circulation fan 41 and the second circulation flow path V2 flowing by the second circulation fan 42 may be formed. Details thereof will be described later.

The cooking equipment 1 may include the rear bracket 52. The rear bracket 52 may include a circulation fan receiver 521 provided to accommodate the second circulation fan 42.

One surface (the cooling divider 51) of the rear bracket 52 facing the electronic equipment chamber 60 may be provided to partition the electronic equipment chamber 60 and the circulation fan receiver 521. The electronic equipment chamber 60 and the circulation fan receiver 521 may not communicate with each other. The rear bracket 52 may include a communicator 522 provided to be opened to communicate with the circulation fan receiver 521. According to a shape of the rear bracket 52, the air introduced through the second circulation air intake 15 may flow to the inside of the main body 10 along the circulation flow path V2.

The first circulation fan 41 may generate an intake force to allow air to be introduced into the first circulation air intake 14 formed on the bottom plate 97. A side plate 89 of the inner housing 12 may be mounted on an upper side of the first circulation fan 41. A portion of the side plate 89 may be cut to allow the introduced air to flow to the upper side of the first circulation fan 41.

The second circulation fan 42 may generate an intake force to allow air to be introduced into the second circulation air intake 15 formed on the bottom plate 97. The second circulation fan 42 may be disposed in the circulation fan receiver 521 of the rear bracket 52. The air introduced through the second circulation air intake 15 may move along the rear of the main body 10 through the communicator 522 of the rear bracket 52, and then flow to the upper side of the inner housing 12.

Figure 6:
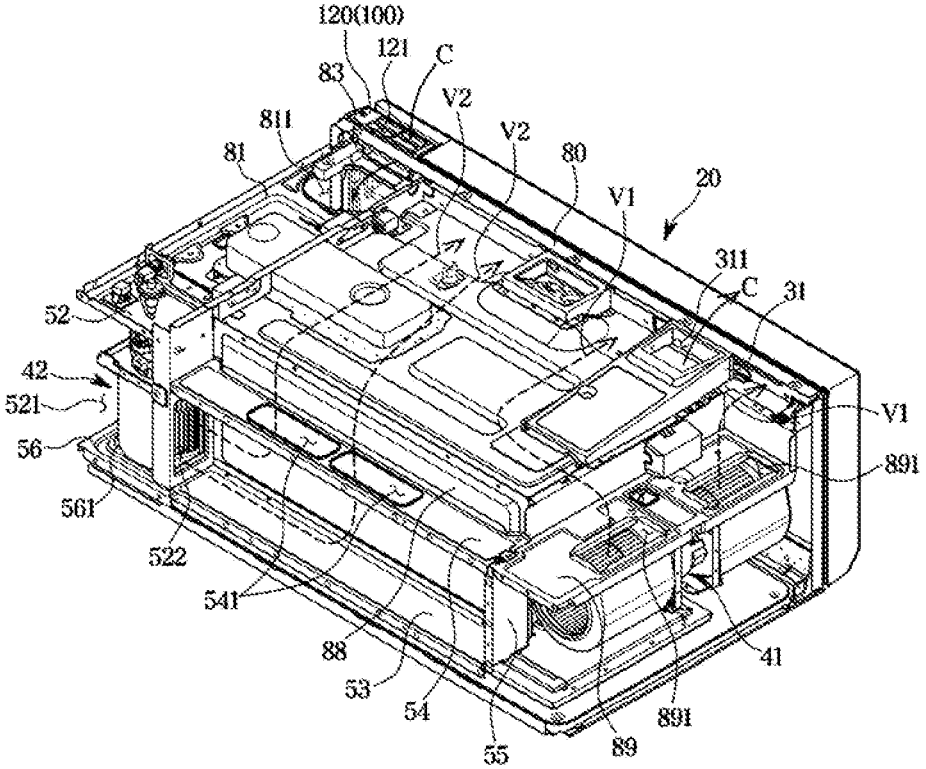
FIG. 6 is a rear perspective view illustrating air flow in a state where the outer housing is removed from the cooking equipment according to an embodiment of the disclosure.
Figure 7:
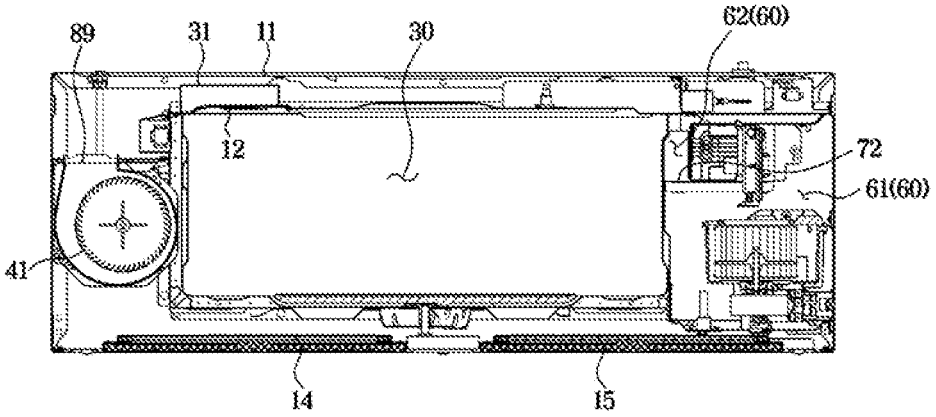
FIG. 7 is a cross-sectional view of the cooking equipment according to an embodiment of the disclosure.

FIG. 6 is a rear perspective view illustrating air flow in a state where the outer housing is removed from the cooking equipment according to an embodiment of the disclosure. FIG. 7 is a cross-sectional view of the cooking equipment according to an embodiment of the disclosure.

Hereinafter, the first circulation flow path V1, the second circulation flow path V2 and the cooling flow path C of the cooking equipment 1 according to an embodiment of the disclosure are described.

Referring to FIG. 5 and FIG. 6, air may be introduced into the main body 10 through the first circulation air intake 14 formed in the lower portion of the main body 10. The introduced air may be polluted air containing oil vapor.

The introduced air may be filtered and pass through the first circulation fan 41. The air passing through the first circulation fan 41 may flow to the side plate 89 arranged above the first circulation fan 41.

The side plate 89 may include a first communication hole 891. The air passing through the first circulation fan 41 through the first communication hole 891 may flow to the upper portion of the inner housing 12.

The flowing air may be discharged again to the outside of the cooking equipment 1 through the first circulation air outlet 911 and the second circulation air outlet 921 formed in the front upper portion of the main body 10, as shown in FIG. 3, which may be referred to as the first circulation flow path V1.

Alternatively, in a state where a separate communication duct is provided for discharging the filtered oil vapor to the outside, the air introduced into the first circulation air intake 14 may be discharged to the outside of the cooking equipment 1 by passing through the circulation air outlet formed in the ventilation duct panel 94, as described above.

Referring to FIG. 4 and FIG. 6, air may be introduced into the main body 10 through the second circulation air intake 15 formed at the lower portion of the main body 10. The introduced air may also be polluted air containing oil vapor.

The introduced air may be filtered and pass through the second circulation fan 42. More specifically, the air may be introduced into the circulation fan receiver 521 of the rear bracket 52 through a through hole 561 formed in the circulation plate 56.

The communicator 522 of the rear bracket 52 may be formed in a portion defining between a back plate 95 of the outer housing 11 and a rear plate 88 of the inner housing 12. Accordingly, the air introduced into the through hole 561 may flow to the rear of the inner housing 12 through the communicator 522.

The cooking equipment 1 may include a bottom bracket 53, a partition bracket 54, and a circulation divider 55.

The bottom bracket 53 and the partition bracket 54 may be disposed between the outer housing 11 and the inner housing 12. More specifically, the bottom bracket 53 and the partition bracket 54 may be arranged at the rear of the inner housing 12 and extend horizontally. The partition bracket 54 may be disposed above the bottom bracket 53 to face the partition bracket 54.

The circulation divider 55 may be disposed between the outer housing 11 and the inner housing 12. Specifically, the circulation divider 55 may be disposed at the rear of the inner housing 12 and extend vertically. That is, the circulation divider 55 may be arranged to face the communicator 522 of the rear bracket 52.

The partition bracket 54 may include a second communication hole 541. The second communication hole 541 may be formed by cutting a portion of the partition bracket 54. The second communication hole 541 may be provided to allow air to flow.

Accordingly, the rear bracket 52, the bottom bracket 53, the partition bracket 54, and the circulation divider 55 may be provided to form a part of a flow path through which the air introduced into the second circulation air intake 15 flows.

The air introduced into the second circulation air intake 15 may pass through the through hole 561 of the circulation plate 56, pass through the second circulation fan 42, pass through the communicator 522 of the rear bracket 52, and then flow between the bottom bracket 53 and the partition bracket 54.

In this instance, the circulation divider 55 may be closed without an opening and may be disposed between the partition bracket 54 and the bottom bracket 53. Accordingly, the flowing air may flow to the upper rear side of the inner housing 12 through the second communication hole 541 of the partition bracket 54.

The air flowing to the upper side of the inner housing 12 through the second communication hole 541 may be discharged again to the outside of the cooking equipment 1 through the first circulation air outlet 911 and the second circulation air outlet 921 formed in the upper front portion of the main body 10, which may be referred to as the second circulation flow path V2.

Alternatively, in a state where a separate communication duct is provided for discharging the filtered oil vapor to the outside, the air introduced into the second circulation air intake 15 may be discharged to the outside of the cooking equipment 1 by passing through the circulation air outlet formed in the ventilation duct panel 94, as described above.

Because the circulation divider 55 is provided to be closed, the air introduced by the first circulation fan 41 and the air introduced by the second circulation fan 42 may be moved separately in the lower portion of the inner housing 12, and then mixed in the upper portion of the inner housing 12.

Referring to FIG. 6 and FIG. 7, the air introduced into the intake grille 120 disposed on the upper portion of the controller 100 may flow into the first electronic equipment chamber 61 and the second electronic equipment chamber 62 to cool various electronic components. More specifically, the air introduced into the first cooling air inlet 121 of the intake grille 120 may be introduced into the inside of the main body 10 through the second cooling air inlet 83 of the front panel 80. Thereafter, the air may be introduced into the electronic equipment chamber 60 through a cutout 811 formed in the upper plate 81 of the inner housing 12.

The air introduced into the first electronic equipment chamber 61 may be introduced into the second electronic equipment chamber 62 through the cooling fan 71, and the air introduced into the second electronic equipment chamber 62 may be guided into the cooking chamber 30 by the guide duct 72 provided to communicate with a side surface of the cooking chamber 30. The air guided into the cooking chamber 30 may cool the rear surface of the door 20 and then flow to the exhaust duct 31 communicating with the upper surface of the cooking chamber 30. The exhaust duct 31 may be provided to communicate with the cooling air outlet 93. Accordingly, the air that completes cooling may be discharged to the outside of the cooking equipment 1 through the cooling air outlet 93, which may be referred to as the cooling flow path C.

Figure 8:
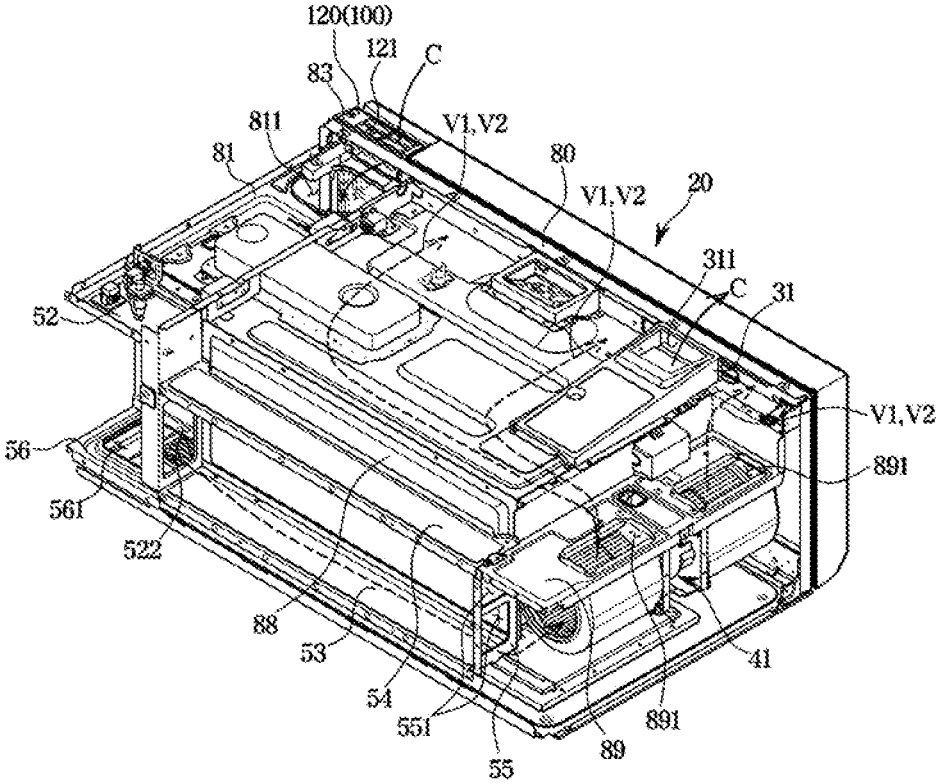
FIG. 8 is a rear perspective view illustrating air flow in a state where the outer housing is removed from cooking equipment according to another embodiment of the disclosure.

FIG. 8 is a rear perspective view illustrating air flow in a state where the outer housing is removed from a cooking equipment according to another embodiment of the disclosure.

The cooking equipment according to another embodiment of the disclosure may include a single circulation fan 41, unlike the cooking equipment 1 according to an embodiment of the disclosure. Specifically, the cooking equipment according to another embodiment may include only the first circulation fan 41.

Further, the cooking equipment according to another embodiment of the disclosure includes the same configuration as the cooking equipment 1 according to an embodiment of the disclosure, except that the configuration of the circulation divider 55 and the partition bracket 54 is different. The same components may include the same reference numbers, and thus a description that is the same as the cooking equipment 1 described above is omitted.

The cooking equipment according to another embodiment of the disclosure may include the first circulation fan 41 disposed between the inner housing 12 and the outer housing 11. Air may be drawn into the first circulation air inlet and the second circulation air inlet through the first circulation fan 41.

More specifically, the air introduced into the first circulation air inlet may pass through the first communication hole 891 of the side plate 89 by passing through the first circulation fan 41. The air passing through the first communication hole 891 may be discharged to the outside of the cooking equipment through the first circulation air outlet 911 of the service panel 91 and the second circulation air outlet 921 of the discharge panel 92.

Alternatively, in a state where a separate communication duct (not shown) is provided for discharging the filtered oil vapor to the outside, the air introduced into the first circulation air inlet may be discharged to the outside of the cooking equipment by passing through the circulation air outlet formed in the ventilation duct panel 94, as described above.

However, the air introduced into the second circulation air inlet may pass through the through hole 561 of the circulation plate 56 and the communicator 522 of the rear bracket 52, and then flow into a space between the partition bracket 54 and the bottom bracket 53.

In this instance, the partition bracket 54 may be provided to be closed without an opening. Specifically, unlike the cooking equipment 1 according to an embodiment of the disclosure, the second communication hole 541 may not be formed in the partition bracket 54.

However, the partition bracket 54 may be closed and the second communication hole 551 may be formed in the circulation divider 55. Accordingly, the air introduced into the second circulation air inlet may flow into the space between the partition bracket 54 and the bottom bracket 53, and flow to the first circulation fan 41 by passing through the second communication hole 551 of the circulation divider 55.

Thereafter, the air passing through the first circulation fan 41 may flow to the upper portion of the inner housing 12 through the first communication hole 891 of the side plate 89. The flowing air may be discharged to the outside of the cooking equipment through the first circulation air outlet 911 of the service panel 91 and the second circulation air outlet 921 of the discharge panel 92.

Alternatively, in a state where a separate communication duct (not shown) is provided for discharging the filtered oil vapor to the outside, the air introduced into the second circulation air inlet may be discharged to the outside of the cooking equipment by passing through the circulation air outlet formed in the ventilation duct panel 94, as described above.

Unlike the cooking equipment 1 according to the embodiment of the disclosure, the cooking equipment according to another embodiment of the disclosure may draw in air through the first circulation air inlet and the second circulation air inlet by using only an intake force of the first circulation fan 41 by closing the partition bracket 54 and opening the circulation divider 55.

Accordingly, because the cooking equipment is manufactured with a simpler structure, the manufacturing cost may be reduced. In addition, only the configuration of the partition bracket 54 and the circulation divider 55 may be replaced according to the user's needs, without changing the complex internal design according to the number of circulation fans.

Figure 9:
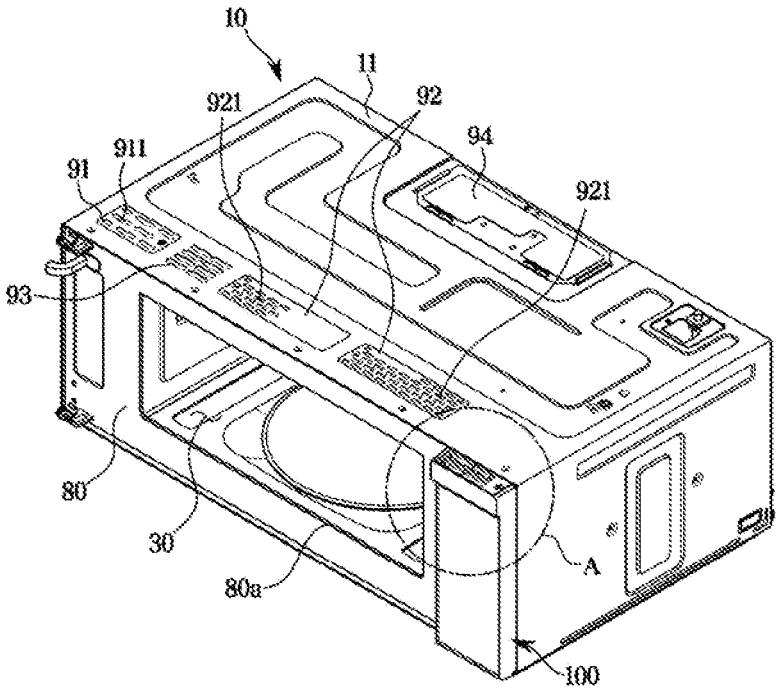
FIG. 9 is a view illustrating a state in which a controller is coupled to a main body of the cooking equipment according to an embodiment of the disclosure.
Figure 10:
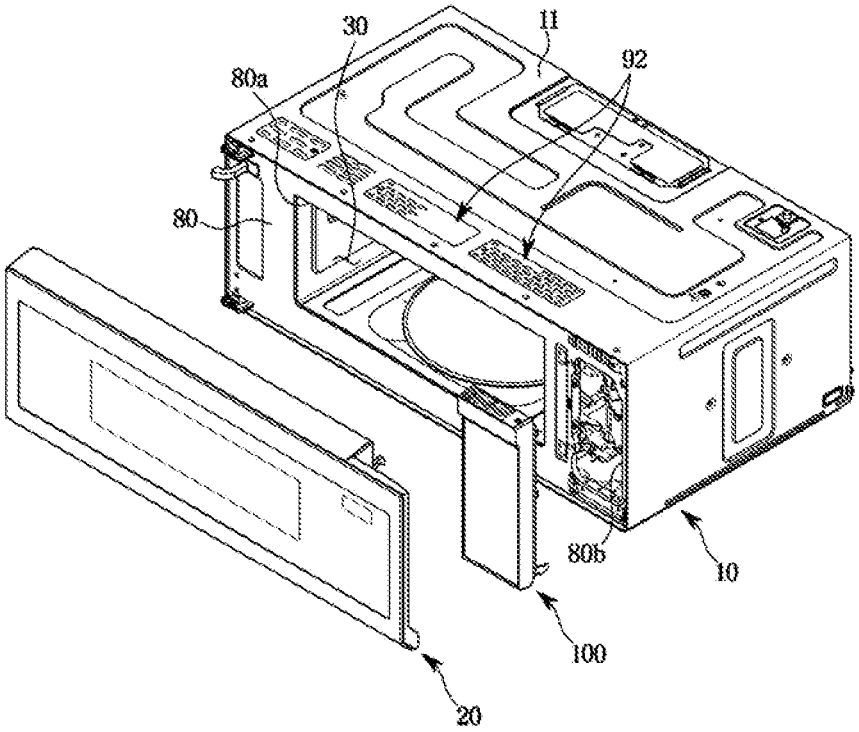
FIG. 10 is an exploded perspective view illustrating a door, the controller, and the main body of the cooking equipment according to an embodiment of the disclosure.
Figure 11:
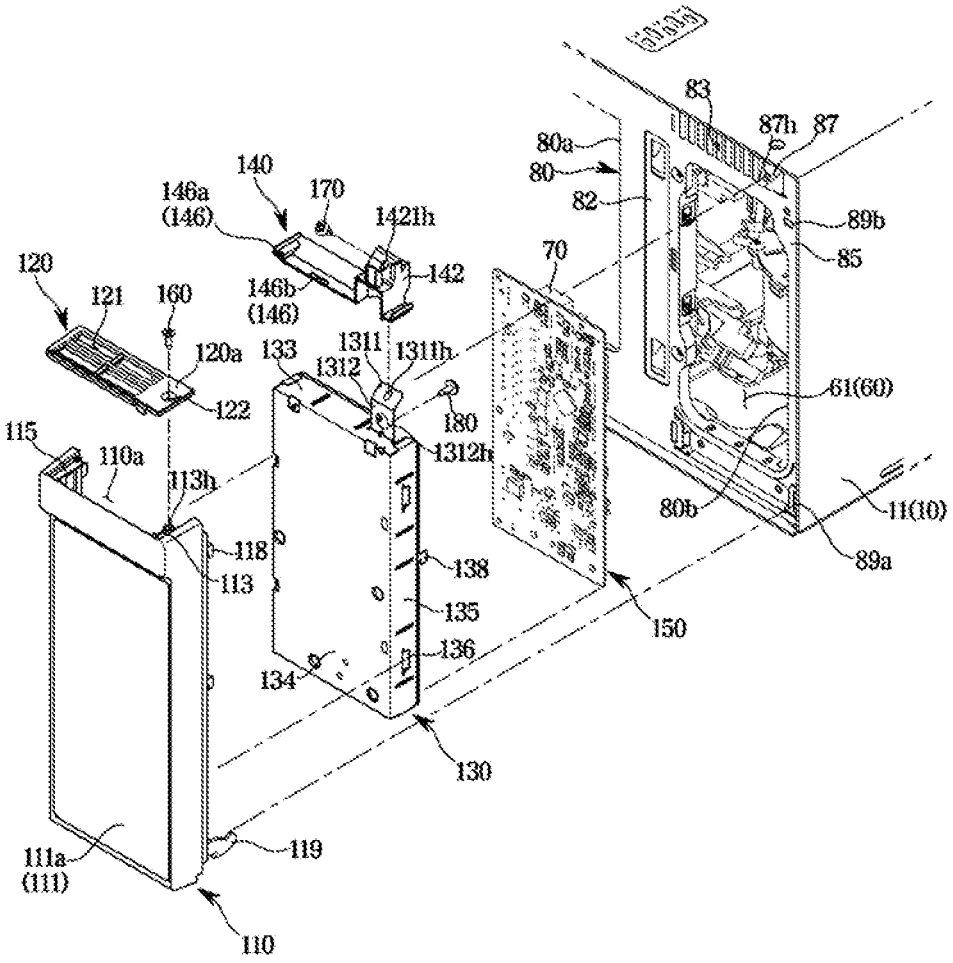
FIG. 11 is an enlarged perspective view of the controller and the main body shown in FIG. 10.
Figure 12:
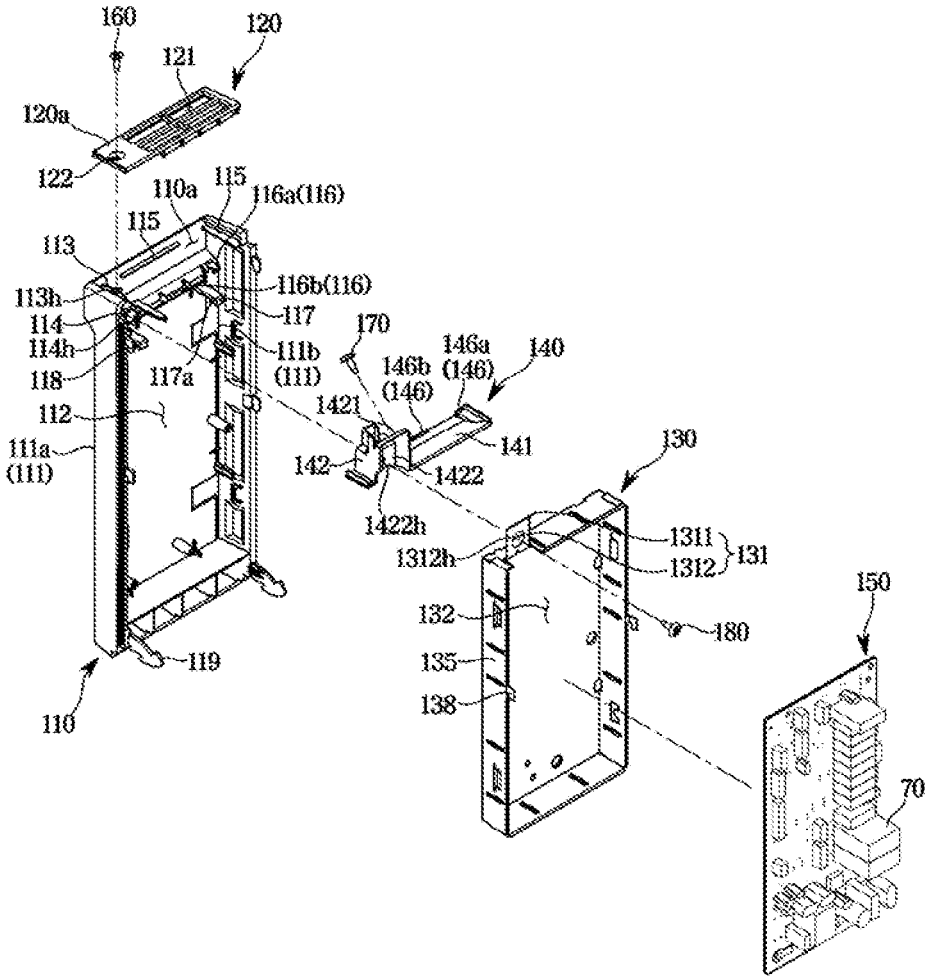
FIG. 12 is an exploded perspective view of the controller shown in FIG. 11 from a rear.

FIG. 9 is a view illustrating a state in which a controller is coupled to a main body of the cooking equipment according to an embodiment of the disclosure. FIG. 10 is an exploded perspective view illustrating a door, a controller, and a main body of the cooking equipment according to an embodiment of the disclosure. FIG. 11 is an enlarged perspective view of the controller and the main body shown in FIG. 10. FIG. 12 is an exploded perspective view of the controller shown in FIG. 11 from a rear.

Referring to FIG. 9 to FIG. 11, the main body 10 may include the front plate 80. The front plate 80 may include a first opening 80*a* communicating with the cooking chamber 30 and a second opening 80*b* communicating with the electronic equipment chamber 60. In addition, the front plate 80 may include a mounting part 85 on which the controller 100 is mounted. The mounting part 85 may include the second opening 80*b*.

The front plate 80 may include a door fixing part 82 provided between the first opening 80*a* and the mounting part 85. Specifically, a door latch (not shown) is inserted into the door fixing part 82 to maintain a state where the door 20 closes the cooking chamber 30.

Referring to FIG. 9 and FIG. 10, the cooking equipment 1 may include the controller 100 detachably coupled to the front of the main body 10. The rear of the controller 100 may be disposed adjacent to the electronic equipment chamber 60. Specifically, the controller 100 may be detachably coupled to the mounting part 85 of the front plate 80 of the inner housing 12.

The controller 100 may be provided to control an operation of the cooking equipment 1. The controller 100 may be provided to control electronic components for performing a cooking function of the cooking equipment 1. For example, the controller 100 may accommodate a circuit board 150 to be described later.

Referring to FIG. 11 and FIG. 12, the controller 100 may include a case 110, a bracket panel 130, a guide panel 140, and the circuit board 150.

The case 110 may accommodate the bracket panel 130, the guide panel 140 and the circuit board 150. The case 110 may be provided to form an exterior of the controller 100. In a state where the controller 100 is mounted on the main body 10, a front surface 110*a* of the case 110 may form a front surface of the controller 110.

The case 110 may include a case body 111. The case body 111 may include an open portion 110*a* with an open top. A first accommodating portion 112 accommodating the bracket panel 130 may be provided inside the case body 111.

An intake grille 120 may be mounted on an upper portion of the case 110. For stable mounting of the intake grille 120, a grille support 115 may be provided on a rear surface 110*b* of the case 110.

The case 110 may include a grille coupling portion 113 provided to be coupled to the intake grille 120. For example, the grille coupling portion 113 may include a grille coupling hole 113*h* corresponding to a case coupling hole 122 of the intake grille 120 to be described later.

The case 110 may include a panel coupling portion 114 provided to be coupled to at least one of the guide panel 140 or the bracket panel 130. Specifically, the panel coupling portion 114 of the case 110 may be coupled to a second bracket coupling portion 1422 of the guide panel 140 to be described later, or may be coupled to a second guide coupling portion 1312 of the bracket panel 130. For example, the panel coupling portion 114 may include a panel coupling hole 114*h* corresponding to a second bracket coupling hole 1422*h* of the guide panel 140 to be described later or a second guide coupling hole 1312*h* of the bracket panel 130.

The case 110 may include a guide fixing part 116 provided to fix the guide panel 140. The guide fixing part 116 may limit a movement of the guide panel 140 inside the case 110. Accordingly, the guide fixing part 116 may prevent the guide panel 140 from being damaged by an external impact or being moved from its original position. For example, the guide fixing part 116 may include at least one of a hook 116*a* or a protrusion locking portion 116*b* formed on the rear surface 110*b* of the case body 110. The hook 116*a* may correspond to a hook locking portion 146*a* of the guide panel 140 to be described later, and the protrusion locking portion 116*b* may correspond to a locking protrusion 146*b* of the guide panel 140 to be described later.

The case 110 may include a board fixing part 117 provided to fix the circuit board 150 to be described later. The board fixing part 117 may limit a movement of the circuit board 150 inside the case 110. Accordingly, the board fixing part 117 may prevent the circuit board 150 from being damaged by an external impact or being moved from its original position. For example, the board fixing part 117 may include a fitting portion 117*a* into which an upper end of the circuit board 150 is inserted.

The case 110 may include body mounting portions 118 and 119 provided to allow the controller 100 to be mounted on the main body 10. For example, the body mounting portions 118, 119 may include the insertion leg 119 and the fixing protrusion 118. In a state where the insertion leg 119 of the case 110 is inserted into a leg groove 89*a* of the front plate 80, the case 110 is rotated about the insertion leg 119 to allow the fixing protrusion 118 to be inserted into a protrusion groove 89*b*.

The intake grille 120 may be mounted on the upper portion of the case 110. For example, the intake grille 120 may be supported by the grille support 115 formed in the case 110.

The intake grille 120 may be provided to cover the open portion 110*a* of the case 110. The intake grille 120 may be provided to cover a portion of the guide panel 140 and the main body 10. Specifically, the intake grille 120 may be provided to cover the second cooling air inlet 83 provided on the front plate 80 of the main body 10. The intake grille 120 may also be referred to as the cover panel 120.

The intake grille 120 may include an intake grille body 120*a*.

The case coupling hole 122 provided to be coupled to the case 110 may be formed in the intake grille body 120*a*. The case coupling hole 122 may correspond to the grille coupling hole 113*h* of the case 110. For example, the case coupling hole 122 and the grille coupling hole 113*h* may be screwed by a first fastening member 160. However, the coupling method is not limited thereto, and various coupling methods may be applied.

The first cooling air inlet 121 through which air is introduced to cool the electronic equipment chamber 60 may be formed in the intake grille body 120*a*. Air introduced through the first cooling air inlet 121 may pass through the second cooling air inlet 83, formed on the front plate 80, and may be introduced into the electronic equipment chamber 60. The air introduced into the electronic equipment chamber 60 may cool the electronic equipment chamber 60. Accordingly, a temperature of various electronic components disposed in the electronic equipment chamber 60 may be lowered, and stability of the electronic components may be increased.

The bracket panel 130 may be provided to accommodate the circuit board 150. The bracket panel 130 may include a second accommodating portion 132 accommodating the circuit board 150. The bracket panel 130 may be provided to protect the circuit board 150 from an external impact, foreign substances, and the like.

The guide panel 140 may be mounted on an upper surface 133 of the bracket panel 130. Specifically, the bracket panel 130 may include a guide coupling portion 131 provided to be coupled to the guide panel 140.

The guide coupling portion 131 may include a first guide coupling portion 1311 and the second guide coupling portion 1312. The second guide coupling portion 1312 extends upward from the upper surface 133 of the bracket panel 130, and the first guide coupling portion 1311 may extend obliquely upward from the second guide coupling portion 1312.

The first guide coupling portion 1311 may correspond to a first bracket coupling portion 1421 of the guide panel 140. For example, the first guide coupling portion 1311 may include a first guide coupling hole 1311*h* that may be coupled to a first bracket coupling hole 1421*h*. In addition, the first guide coupling hole 1311*h* may be coupled to a unit coupling hole 87*h* of the main body 10. The unit coupling hole 87*h*, the first guide coupling hole 1311*h*, and the first bracket coupling hole 1421*h* may communicate with each other. The first guide coupling hole 1311*h* may be disposed between the first bracket coupling hole 1421*h* and the unit coupling hole 87*h*. The unit coupling hole 87*h*, the first guide coupling hole 1311*h*, and the first bracket coupling hole 1421*h* may be screwed together by a second fastening member 170. However, the above-described coupling method is only an example, and various coupling methods may be applied.

The second guide coupling portion 1312 may correspond to the second bracket coupling portion 1422 of the guide panel 140. For example, the second guide coupling portion 1312 may include the second guide coupling hole 1312*h* that may be coupled to the second bracket coupling hole 1422*h*. In addition, the second guide coupling hole 1312*h* may be provided to communicate with the panel coupling hole 114*h* of the case 110 with the second bracket coupling hole 1422*h* interposed therebetween. The second guide coupling hole 1312*h*, the second bracket coupling hole 1422*h*, and the panel coupling hole 114*h* of the case 110 may be screwed together by a third fastening member 180. However, the above-described coupling method is only an example, and various coupling methods may be applied.

The guide panel 140 may be accommodated inside the case 110. The guide panel 140 may be mounted on the upper surface 133 of the bracket panel 130. The guide panel 140 may be disposed between a lower side of the intake grille 120 and the upper side of the bracket panel 130.

The guide panel 140 may include a guide panel body 141. The guide panel body 141 may guide moisture introduced into the controller 100 to an area between the guide panel 140 and the case 110. The guide panel body 141 may be spaced apart from the rear surface 110*b* of the case 110. The guide panel body 141 may have a shape inclined downward toward the front. The guide panel body 141 may include an inclined surface 141*a* inclined toward the case 110. That is, one side of the inclined surface 141*a* close to the main body 10 may be located higher than the other side of the inclined surface 141*a* close to the case 110.

The guide panel 140 may be detachably coupled to the bracket panel 130. The guide panel 140 may be detachably coupled to the front plate 80 of the main body 10. The guide panel 140 may be detachably coupled to the case 110. The guide panel 140 may be a panel for providing a coupling force among components of the controller 100.

The guide panel 140 may couple the main body 10 and the bracket panel 130. The guide panel 140 may couple the case 110 and the bracket panel 130.

The guide panel 140 may include a bracket coupling portion 142. The bracket coupling portion 142 may have a shape extending upward from the guide panel body 141. The bracket coupling portion 142 may be provided in a shape corresponding to the guide coupling portion 131 of the bracket panel 130. For example, the bracket coupling portion 142 may include the first bracket coupling portion 1421 corresponding to the first guide coupling portion 1311 and the second bracket coupling portion 1422 corresponding to the second guide coupling portion 1312.

As described above, the first bracket coupling portion 1421 may include the first bracket coupling hole 1421*h* corresponding to the first guide coupling hole 1311*h* of the bracket panel 130 and the unit coupling hole 87*h* of the main body 10. The first bracket coupling hole 1421*h*, the first guide coupling hole 1311*h*, and the unit coupling hole 87*h* may be screwed together by the second fastening member 170, without being limited thereto. In addition, the second bracket coupling portion 1422 may include the second bracket coupling hole 1422*h* corresponding to the second guide coupling hole 1312*h* of the bracket panel 130 and the panel coupling hole 114*h* of the case 110. The second bracket coupling hole 1422*h*, the second guide coupling hole 1312*h*, and the panel coupling hole 114*h* may be screwed together by the third fastening member 180, without being limited thereto.

The guide panel 140 may include a guide rib 143. The guide rib 143 may be provided to guide a tool T entering the guide panel 140. Specifically, the guide rib 143 may guide a movement of the tool T entering the bracket coupling portion 142 to couple the guide panel 140 to the bracket panel 130 and the front plate 80 of the main body 10. Alternatively, the guide rib 143 may guide a movement of the tool T entering to separate the guide panel 140 from the bracket panel 130 and the front plate 80 of the main body 10.

In general, a circuit board on which various electronic components are mounted may be accommodated in the controller. In addition, various electronic components mounted inside an electronic equipment chamber may be electrically connected to the circuit board. Accordingly, for repair and maintenance of components (e.g., electronic components, electrical components, etc.) of the cooking equipment, the controller is required to be disassembled and/or assembled from the main body.

When disassembling and/or assembling the controller, in the case of cooking equipment positioned above a cooking space, such as an over-the-range (OTR), the arrangement of the cooking equipment requires an operator to perform the service without securing a view. That is, because the operator puts the tool T into the controller without being able to secure a view, the controller may be pressed by the tool T, which damages an exterior.

According to the disclosure, the guide panel 140 may include the guide rib 143 to prevent the controller 100 from being damaged by being pressed by the tool T. The guide rib 143 may guide the tool T to allow the tool T to move more accurately toward the first bracket coupling hole 1421*h* of the guide panel 140. In addition, the guide rib 143 may be provided to support an outer circumferential surface of the tool T. In particular, when the tool T enters, the guide rib 143 may be provided so that the tool T is in first contact with the guide rib 143 and not the case 110.

Accordingly, in the case of the cooking equipment 1 located above a cooking space, even when an operator pushes the tool T into the controller 100 without securing a view, the tool T may be supported and guided by the guide rib 143, and thus the controller 100 may be prevented from being stamped by the tool T.

The guide rib 143 may be inclined downward toward the rear to guide the tool T more smoothly. For example, the guide rib 143 may include a first rib 1431 and a second rib 1432 disposed behind the first rib 1431. The second rib 1432 may extend rearward from the first rib 1431. The second rib 1432 may be formed to have a height lower than the first rib 1431. The second rib 1432 may be provided to reinforce a strength of the first rib 1431.

An uppermost end of the guide rib 143 may be located above a center of the first bracket coupling hole 1421*h* of the guide panel 140.

An inclination direction of the first bracket coupling portion 1421 of the guide panel 140 may be different from an inclination direction of the guide rib 143. For example, the first bracket coupling portion 1421 may have a shape inclined upward to the rear, and the guide rib 143 may have a shape inclined downward to the rear.

Figure 13:
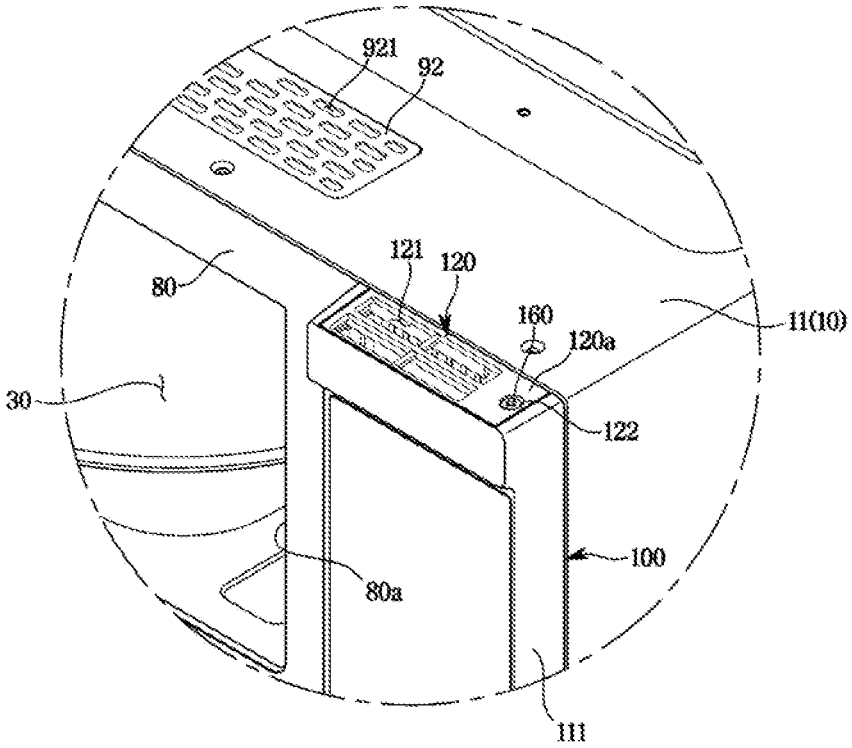
FIG. 13 is an enlarged view of a part A shown in FIG. 9.
Figure 14:
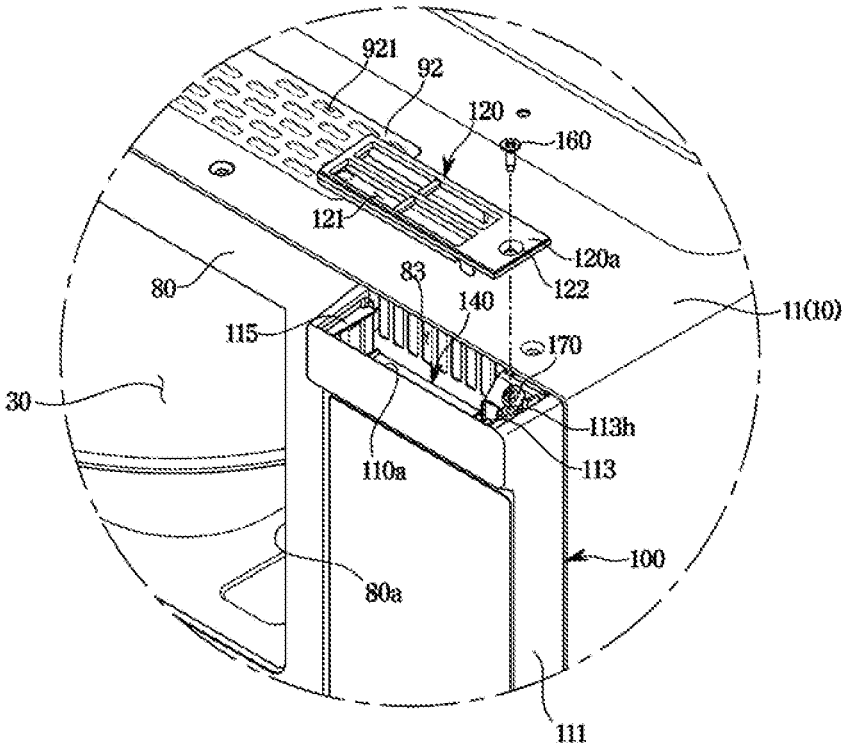
FIG. 14 is a view illustrating a state in which an intake panel is separated from the controller shown in FIG. 13.
Figure 15:
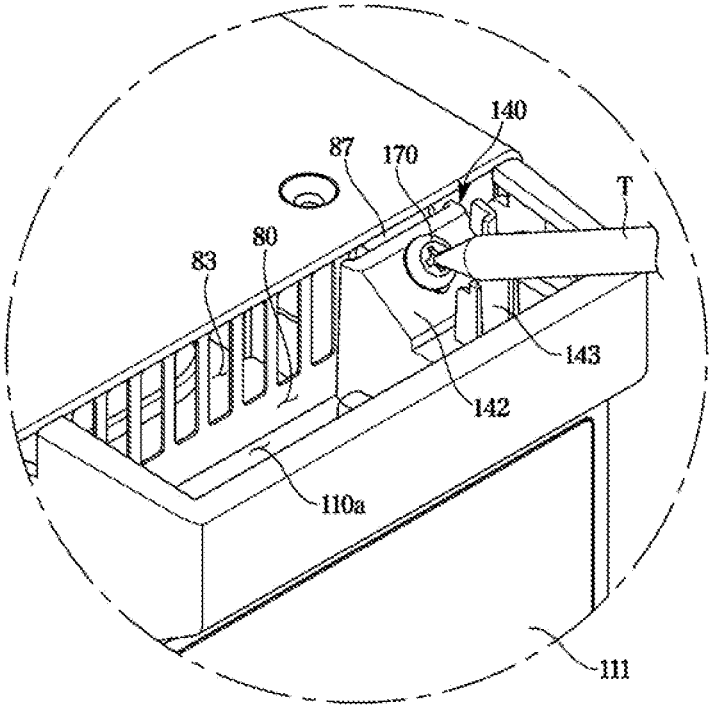
FIG. 15 is a view illustrating a state in which a tool is entered into the controller shown in FIG. 13.
Figure 16:
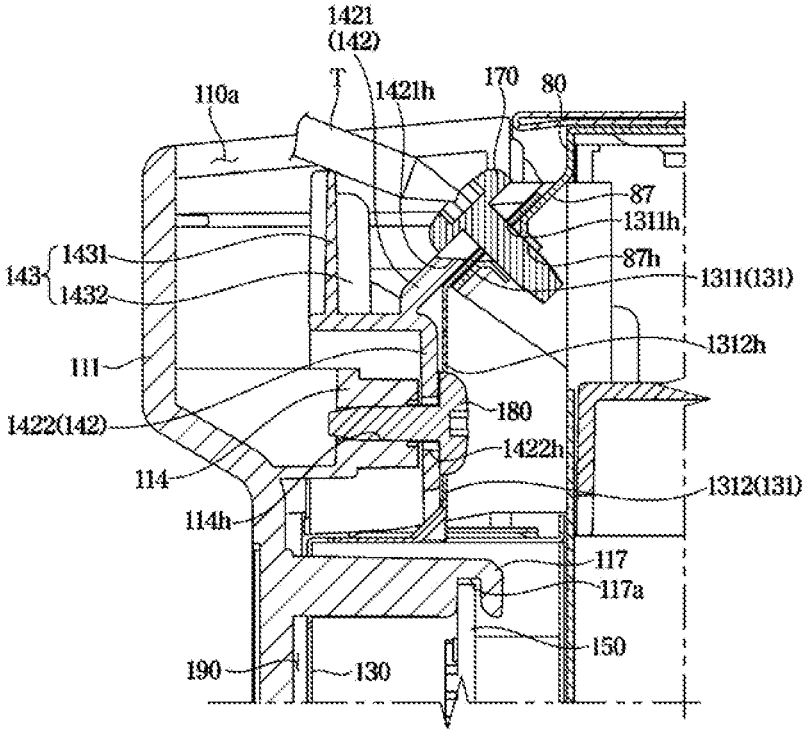
FIG. 16 is a cross-sectional view of the tool and the controller shown in FIG. 15.
Figure 17:
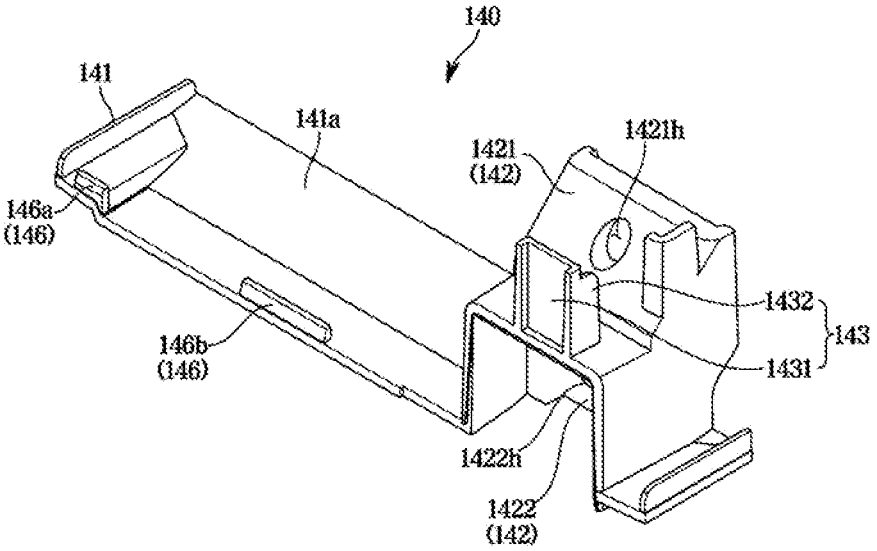
FIG. 17 is a perspective view of a guide panel of the cooking equipment according to an embodiment of the disclosure.
Figure 18:
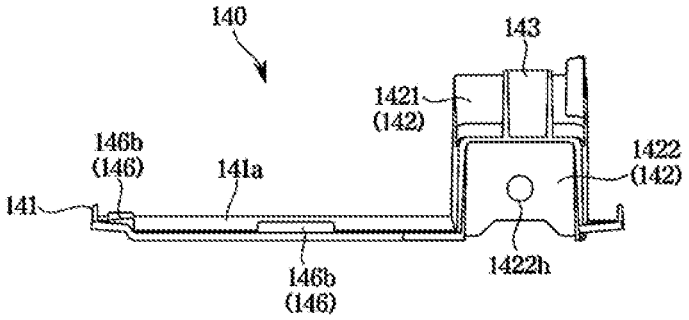
FIG. 18 is a front view of the guide panel shown in FIG. 17.
Figure 19:
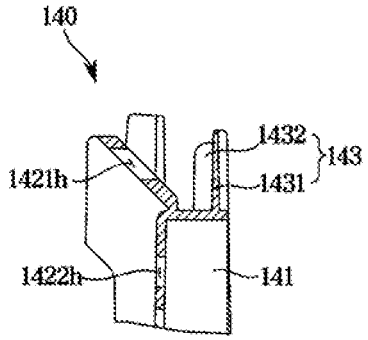
FIG. 19 is a side cross-sectional view of the guide panel shown in FIG. 17.
Figure 20:
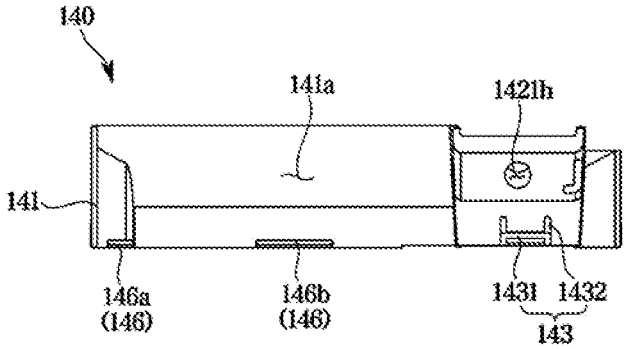
FIG. 20 is a plane view of the guide panel shown in FIG. 17.

FIG. 13 is an enlarged view of a part A shown in FIG. 9. FIG. 14 is a view illustrating a state in which an intake panel is separated from the controller shown in FIG. 13. FIG. 15 is a view illustrating a state in which a tool is entered into the controller shown in FIG. 13. FIG. 16 is a cross-sectional view of the tool and the controller shown in FIG. 15.

A disassembly process of the controller 100 is described with reference to FIG. 13 to FIG. 16.

Referring to FIG. 13 and FIG. 14, in a state where the door 20 opens the cooking chamber 30, the case 110 of the controller 100 and the intake grille 120 may be decoupled. Specifically, by releasing a coupling of the first fastening member 160 fastened to the grille coupling hole 113*h* of the case 110 and the case coupling hole 122 of the intake grille 120, the intake grille 120 may be separated from the case 110.

Referring to FIG. 15, a tool T may enter the case 110 through the open portion 110*a* formed at an upper portion of the case 110. A tip of the tool T may move toward the second fastening member 170 fastened to the first bracket coupling hole 1421*h* of the guide panel 140. In this instance, the guide rib 143 of the guide panel 140 may stably support an outer circumferential surface of the tool T and may guide the movement of the tool. By releasing a coupling of the second fastening member 170 fastened to the first bracket coupling hole 1421*h*, the first guide coupling hole 1311*h*, and the unit coupling hole 87*h*, the controller 100 may be separated from the main body 10. By separating the controller 100 from the main body 10, services such as maintenance and repair of components of the cooking equipment 1 may be performed.

Meanwhile, an assembly order of the controller 100 may be the reverse of the disassembly order of the controller 100 described above.

Although embodiments of the disclosure have been described with reference to the accompanying drawings, a person having ordinary skilled in the art will appreciate that other specific modifications may be easily made without departing from the technical spirit or essential features of the disclosure. Therefore, the foregoing embodiments should be regarded as illustrative rather than limiting in all aspects.

The invention claimed is:

1. A cooking equipment, comprising:
a main body; and
a controller mounted on a front of the main body,
wherein the controller includes:
a case,
a bracket panel inside the case and accommodating a circuit board, and
a guide panel detachably coupled to the bracket panel and a front surface of the main body inside the case,
wherein the guide panel includes a guide rib configured to guide a tool to enter the case to couple the guide panel to the bracket panel and the front surface of the main body or to detach the guide panel from the bracket panel and the front surface of the main body.

2. The cooking equipment of claim 1, wherein the guide rib has a shape inclined downward toward a rear of the cooking equipment.

3. The cooking equipment of claim 1, wherein the guide rib is configured to support an outer circumferential surface of the tool.

4. The cooking equipment of claim 1, wherein
the case includes an opening on an upper surface of the case, and
the guide panel is configured so that, when the tool enters the case, the tool enters the guide panel through the opening of the case, and is in first contact with the guide rib and not the case.

5. The cooking equipment of claim 1, wherein
the main body includes a first hole on the front surface,
the bracket panel includes a second hole corresponding to the first hole,
the guide panel includes a third hole corresponding to the second hole, and
the first hole, the second hole, and the third hole are configured to be screwed together.

6. The cooking equipment of claim 5, wherein an uppermost end of the guide rib is located above a center of the third hole of the guide panel.

7. The cooking equipment of claim 1, wherein
the guide panel further includes a body seated on an upper surface of the guide panel, and
the guide rib extends upward from the body.

8. The cooking equipment of claim 1, wherein
the controller further includes an intake grille configured to cover an upper portion of the case and including a cooling air inlet communicating with an outside of the cooking equipment, and
the guide panel is between a lower side of the intake grille and an upper side of the bracket panel.

9. The cooking equipment of claim 8, wherein
the main body includes a cooking chamber and an electronic equipment chamber partitioned from the cooking chamber, and
a rear of the controller is adjacent to the electronic equipment chamber.

10. The cooking equipment of claim 9, wherein
the cooling air inlet is a first cooling air inlet,
the main body further includes a second cooling air inlet on the front surface of the main body and configured to communicate with the first cooling air inlet, to allow air introduced through the first cooling air inlet of the intake grille to be introduced to the electronic equipment chamber.

11. The cooking equipment of claim 10, wherein the intake grille is configured to cover the guide panel and the second cooling air inlet of the main body.

12. The cooking equipment of claim 1, wherein the guide rib includes:
a first rib, and
a second rib behind the first rib and having a height lower than the first rib.

13. The cooking equipment of claim 1, wherein the guide panel is configured to couple the case and the bracket panel.

14. The cooking equipment of claim 13, wherein
the bracket panel includes a first hole,
the guide panel includes a second hole corresponding to the first hole,
the case includes a third hole corresponding to the second hole, and
the first hole, the second hole, and the third hole are configured to be screwed together.

15. The cooking equipment of claim 7, wherein the body of the guide panel is spaced apart from a rear surface of the case and has a shape inclined downward toward a front of the cooking equipment, to guide moisture introduced into the controller between the guide panel and the case.

* * * * *